US010475563B2

(12) United States Patent
Marone et al.

(10) Patent No.: US 10,475,563 B2
(45) Date of Patent: Nov. 12, 2019

(54) DIRECT CURRENT ELECTRIC ACTUATOR, IN PARTICULAR FOR ELECTRICAL HOUSEHOLD APPLIANCES

(71) Applicant: BITRON S.p.A., Turin (IT)

(72) Inventors: Giuseppe Marone, Nichelino (IT); Pierluigi Picco, Turin (IT)

(73) Assignee: BITRON S.P.A., Turin (IT)

( * ) Notice: Subject to any disclaimer, the term of this patent is extended or adjusted under 35 U.S.C. 154(b) by 85 days.

(21) Appl. No.: 15/572,277

(22) PCT Filed: May 27, 2016

(86) PCT No.: PCT/IB2016/053108
§ 371 (c)(1),
(2) Date: Nov. 7, 2017

(87) PCT Pub. No.: WO2016/193874
PCT Pub. Date: Dec. 8, 2016

(65) Prior Publication Data

US 2018/0350496 A1 Dec. 6, 2018

(30) Foreign Application Priority Data

May 29, 2015 (IT) ..... 102015000019304

(51) Int. Cl.
*H01F 7/08* (2006.01)
*H01F 7/16* (2006.01)
(Continued)

(52) U.S. Cl.
CPC ..... *H01F 7/081* (2013.01); *H01F 7/1607* (2013.01); *H01F 27/24* (2013.01);
(Continued)

(58) Field of Classification Search
CPC ..... H01F 7/081; H01F 27/32; H01F 27/2823; H01F 27/24; H01F 7/1607; H01F 2007/083; A47L 15/449; D06F 39/02
See application file for complete search history.

(56) References Cited

U.S. PATENT DOCUMENTS 2,353,835 A * 7/1944 Lane ..... H01F 7/1607 335/260
3,593,240 A 7/1971 Garczynski
(Continued)

FOREIGN PATENT DOCUMENTS

| | | |
|---|---|---|
| EP | 1 722 380 B1 | 5/2012 |
| GB | 2 061 015 A | 5/1981 |
| WO | 2012/107886 A1 | 8/2012 |

OTHER PUBLICATIONS

Written Opinion of the International Searching Authority of PCT/IB/2016/053108 dated Aug. 8, 2016.
(Continued)

*Primary Examiner* — Mohamad A Musleh
(74) *Attorney, Agent, or Firm* — Sughrue Mion, PLLC

(57) ABSTRACT

The actuator (10) comprises a body (12) formed by a single strip of ferromagnetic material, U-shaped and including a first and a second lateral branch (14, 16) facing each other and interconnected by an intermediate branch or portion (18). A first lateral branch (14) of the body (12) has a frustoconical formation (30) which extends in the region outside the body (12). A coil (22) is fixed in the body (12), and its axis (A-A) extends in a direction essentially orthogonal to the lateral branches (14, 16) of this body (12). A ferromagnetic core (28) is mounted so as to be translatable inside the coil (22), from a rest position to a working position, as an effect of the energizing of the coil (22). One end (32) of the core (28), facing towards the first branch (14) of said body (12), has a frustoconical shape essentially
(Continued)

complementary to the internal shape (30*b*) of the formation (30). The frustoconical formation (30) of the first branch (14) of said body (12) is blind and has a planar distal bottom wall (30*a*).

4 Claims, 5 Drawing Sheets

(51) Int. Cl.

| | |
|---|---|
| ***H01F 27/24*** | (2006.01) |
| ***H01F 27/28*** | (2006.01) |
| ***H01F 27/32*** | (2006.01) |
| *A47L 15/44* | (2006.01) |
| *D06F 39/02* | (2006.01) |

(52) U.S. Cl.
CPC ..... *H01F 27/2823* (2013.01); *H01F 27/32* (2013.01); *A47L 15/449* (2013.01); *D06F 39/02* (2013.01); *H01F 2007/083* (2013.01)

(56) References Cited

U.S. PATENT DOCUMENTS

| | | | | |
|---|---|---|---|---|
| 3,987,385 | A | 10/1976 | Diller et al. | |
| 4,496,921 | A * | 1/1985 | Carrera | H01F 7/1607 335/258 |
| 4,679,767 | A * | 7/1987 | Vollmer | H01F 7/1607 251/129.15 |
| 8,641,010 | B2 * | 2/2014 | Christensen | F16K 31/0675 251/129.15 |
| 2004/0181760 | A1 * | 9/2004 | Ismailov | F02D 41/20 703/2 |
| 2005/0012405 | A1 * | 1/2005 | Yajima | H01F 7/1844 310/14 |
| 2010/0147390 | A1 * | 6/2010 | Glaudel | F16K 1/385 137/1 |

OTHER PUBLICATIONS

International Search Report of PCT/IB2016/053108 dated Aug. 8, 2016.

* cited by examiner

DIRECT CURRENT ELECTRIC ACTUATOR, IN PARTICULAR FOR ELECTRICAL HOUSEHOLD APPLIANCES

CROSS REFERENCE TO RELATED APPLICATIONS

This application is a National Stage of International Application No. PCT/IB2016/053108 filed May 27, 2016, claiming priority based on Italian Patent Application No. 102015000019304 filed May 29, 2015, the contents of all of which are incorporated herein by reference in their entirety.

BACKGROUND OF THE INVENTION

Field of the Invention

The present invention relates to electrically operated actuators in general.

More specifically, the invention relates to a direct current electric actuator, for use, in particular, for devices for dispensing washing agents in washing machines, dishwashers and the like, of the type comprising

- a body formed by a single strip of ferromagnetic material, essentially U-shaped and including a first and a second lateral branch, facing each other and interconnected by an intermediate branch or portion,
- a first lateral branch having an essentially frustoconical formation which extends in the region outside said body and converges towards said outside region;
- a coil of insulated electrically conducting wire, fixed in said body such that the axis thereof extends in a direction essentially orthogonal to the lateral branches of said body, and
- a ferromagnetic core mounted so as to be movable with respect to said body in an axially translatable manner inside the coil, from a rest position to a working position, as an effect of the energising of the coil;
- one end of the core, facing towards the first branch of said body, having a frustoconical external shape essentially complementary to the internal shape of said formation.

Background

A direct current electric actuator of this type is known from EP 1 722 380 A1. In this actuator device according to the prior art, the frustoconical formation of the body of ferromagnetic material has its distal end provided with an opening through which the corresponding frustoconical end of the core is accessible from the outside.

In the solution known from the aforementioned prior document, the forming of the body of ferromagnetic material requires operations of preliminary cutting of the base strip, stamping or drawing to form the aforesaid frustoconical formation, further cutting to form the opening at the distal end of said frustoconical formation, and then final bending. A variety of operations and processes are therefore required.

A first object of the present invention is to provide a direct current electric actuator of the type defined initially which can be made with a smaller number of processes and therefore in a more simple and economical way.

SUMMARY OF THE INVENTION

This and other objects are achieved according to the invention with a direct current electric actuator of the type specified above, characterised principally in that the aforesaid frustoconical formation of the first branch of the aforesaid body is blind and has a planar distal bottom wall.

This characteristic makes it possible to avoid, above all, the cutting operation which the prior art solution required in order to provide the terminal opening of the aforesaid frustoconical formation of the ferromagnetic body.

Tests conducted by the inventors have also shown that the solution according to the present invention can considerably increase the intensity of the force exerted on the movable core, from a standing start, in other words from its rest position.

In a currently preferred embodiment, the frustoconical formation of the first branch of the aforesaid body defines an internal cavity having an essentially isosceles trapezium shaped profile in axial cross section, with a longer base about twice as long as the shorter base and a height or distance between said bases equal to about one third of the longer base.

BRIEF DESCRIPTION OF THE DRAWINGS

Further characteristics and advantages of the invention will be apparent from the following detailed description, provided purely by way of non-limiting example, with reference to the appended drawings, in which.

DETAILED DESCRIPTION OF THE INVENTION

Figure 1:
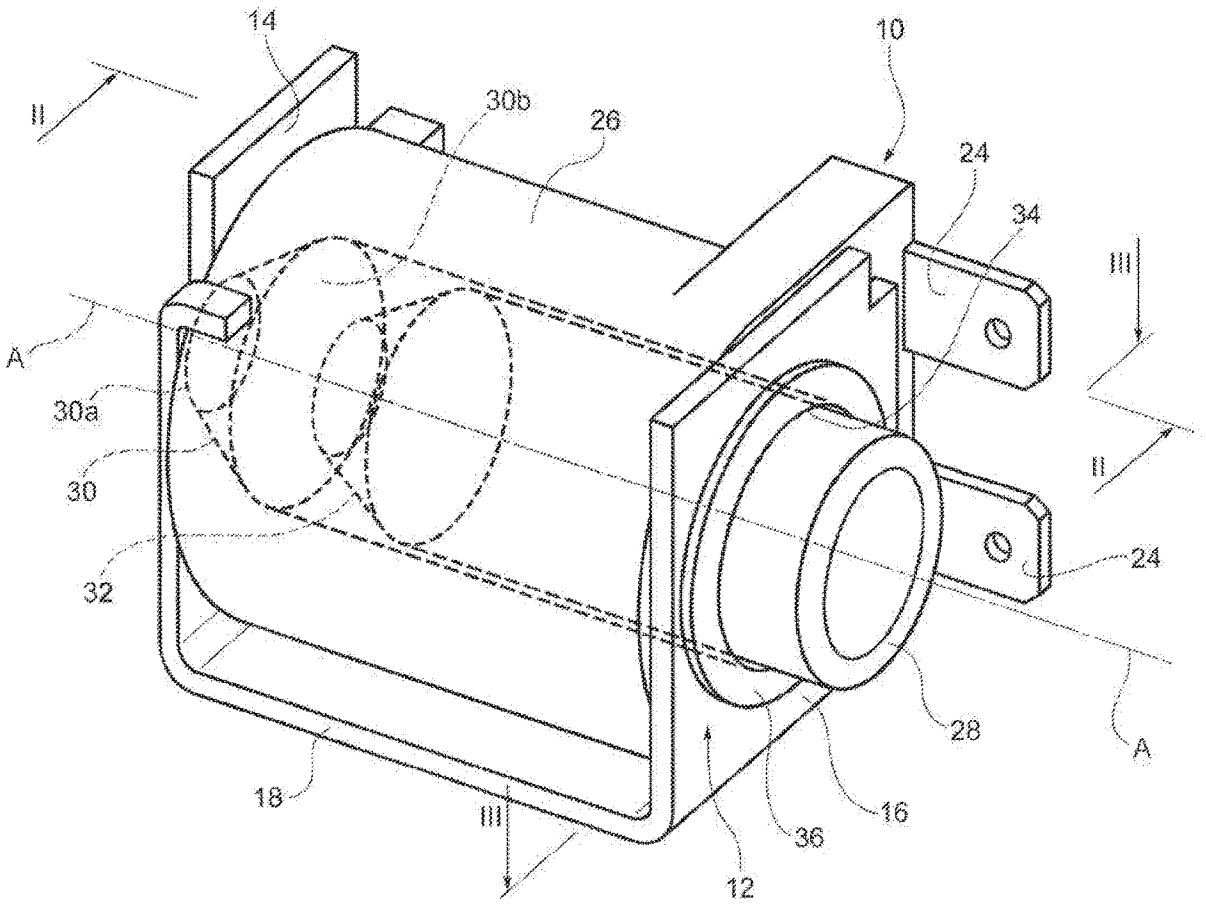
FIG. 1 is a perspective view of a direct current electric actuator according to the present invention.
Figure 3:
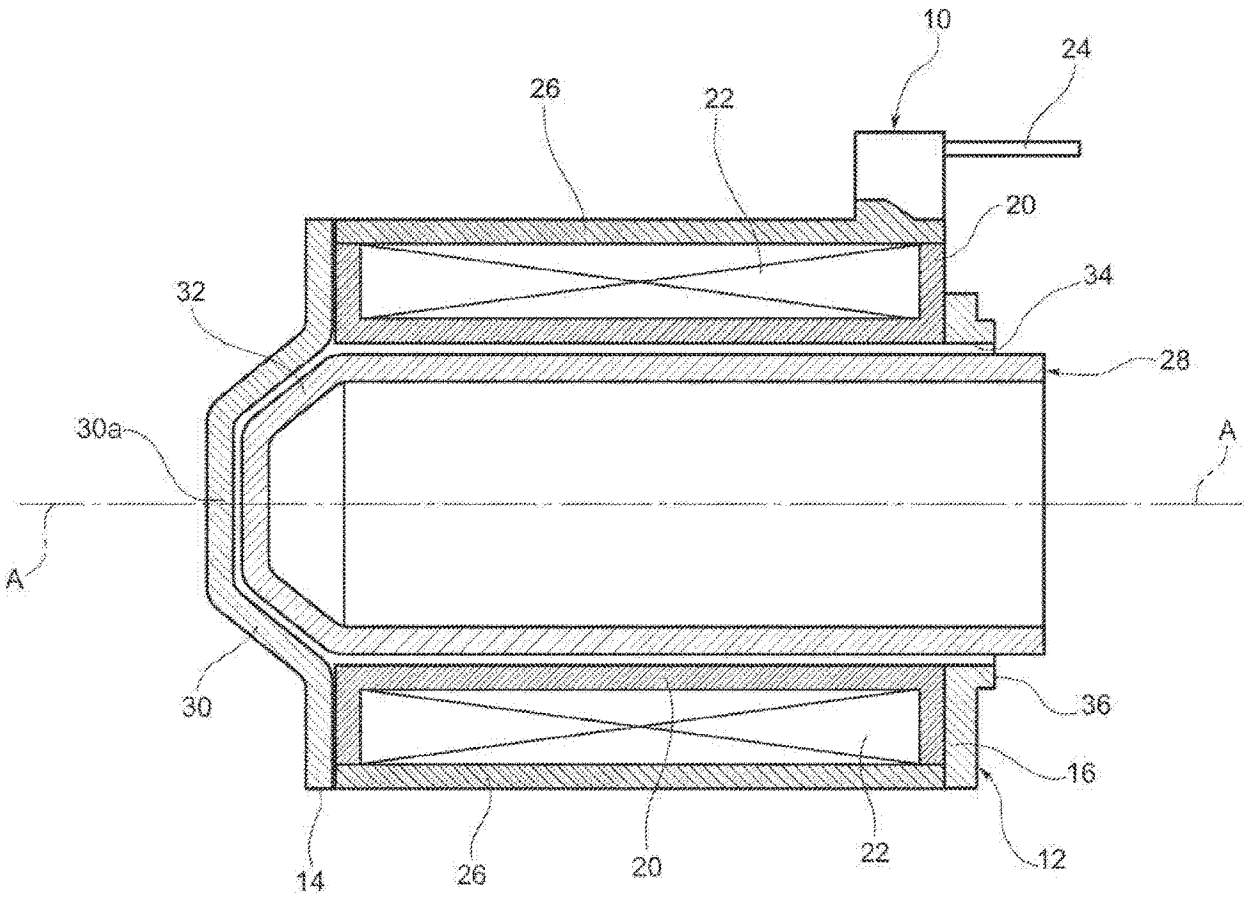
FIG. 3 is a view of a section cut along the line of FIG. 1.

With reference to FIGS. 1 and 3, the number 10 indicates the whole of an electrically operated direct current actuator according to the present invention.

This actuator 10 can be used, for example, in devices for dispensing washing and/or rinsing agents for electrical household appliances such as washing machines, dishwashers and the like, but can also be used in other applications without thereby departing from the scope of the present invention.

In the illustrated embodiment, the actuator 10 comprises a body or shell 12 made in one piece with a substantially U-shaped strip of ferromagnetic material.

The body 12 includes a first and a second lateral branch 14 and 16, opposed to one another and interconnected by an intermediate branch 18.

As shown in FIG. 3, the body or shell 12 houses a spool 20 on which a coil 22 of insulated electrical wire is wound. The coil 22 has a pair of connecting members 24, such as flat connectors.

Preferably, the spool 20 and the coil 22 are enclosed in an insulating housing 26 of substantially cylindrical shape, from which the connecting members 24 protrude to the outside.

The coil 22 has a longitudinal axis A-A extending in a direction substantially orthogonal to the first and second lateral branches 14, 16 of the body or shell 12.

The actuator 10 further comprises a ferromagnetic core 28 mounted movably with respect to the shell 12, so as to be axially translatable inside the coil 22.

The core 28 can pass, in a known way, from an axial rest position, shown in FIG. 1, to an axial working position, shown in FIG. 3, as an effect of the energising of the coil 22.

Optionally, the core 28 may be connected to elastic means (not shown) of a known type, for example a tension or compression spring, designed to retain it and/or return it to the rest position when the coil 22 is de-energised.

Figure 2:
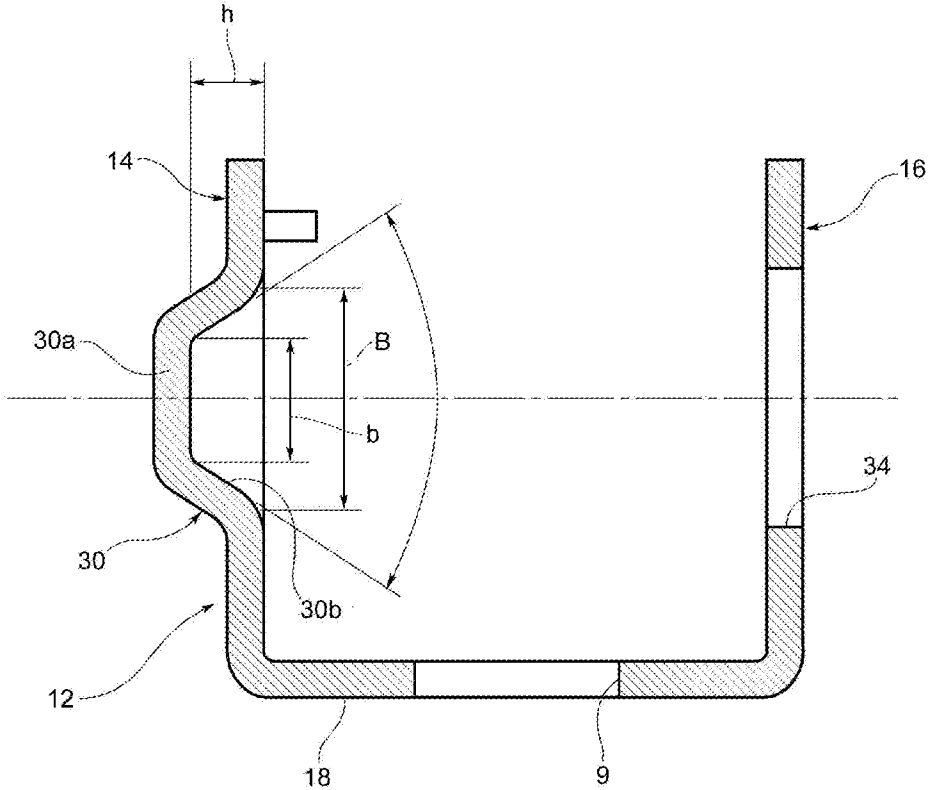
FIG. 2 is a partial view of a section cut along the line II-II of FIG. 1.

As can be seen, in particular, in FIG. 2, the first lateral branch 14 of the body or shell 12 has an essentially frustoconical formation 30 and the core 28 has a corresponding end 32, shaped in a substantially complementary way to the internal shape of the formation 30, which is therefore also substantially frustoconical.

The complementary frustoconical configuration between the external shape of the end 32 of the core 28 and the internal shape of the formation 30 of the body or shell 12 advantageously makes it possible to provide a gap (between the core 28 and the formation 30) whose amplitude is smaller than the travel of the core 28 with respect to said formation 30. Additionally, this configuration allows optimal centring of the core 28 with respect to the shell 12.

The frustoconical formation 30 of the branch 14 of the body or shell 12 extends in the region outside the body 12 and converges conically towards this outside region.

As seen in FIGS. 2 and 3, the frustoconical formation 30 of the body or shell 12 is blind and has a planar distal bottom wall 30*a*.

The blind frustoconical formation 30 is fairly easily made and simply requires a stamping/drawing operation.

In a currently preferred embodiment, illustrated qualitatively in FIG. 2 in particular, the internal cavity 30*b* of the formation 30 has an essentially isosceles trapezium shaped profile in axial cross section, with a longer base B about twice as long as the shorter base b and a height h (distance between the bases b and B) equal to about one third of the longer base B.

This configuration of the internal cavity of the formation 30 makes the stamping/drawing operation particularly easy, while also providing an effective core centring action.

The second lateral branch 16 of the body or shell 12 has an opening 34 through which the core 28 extends towards the outside.

With reference to FIG. 2, in the illustrated embodiment the intermediate branch 18 of the body or shell 12 has a through opening 36, substantially equidistant from the lateral branches 14 and 16, to allow engagement with a gripping device of an assembling apparatus of a type which is known and is not illustrated. This location of the opening 36 is advantageous since it enables the actuator 10 as a whole to be gripped in a central position which may or may not be close to its centre of gravity.

Figure 4:
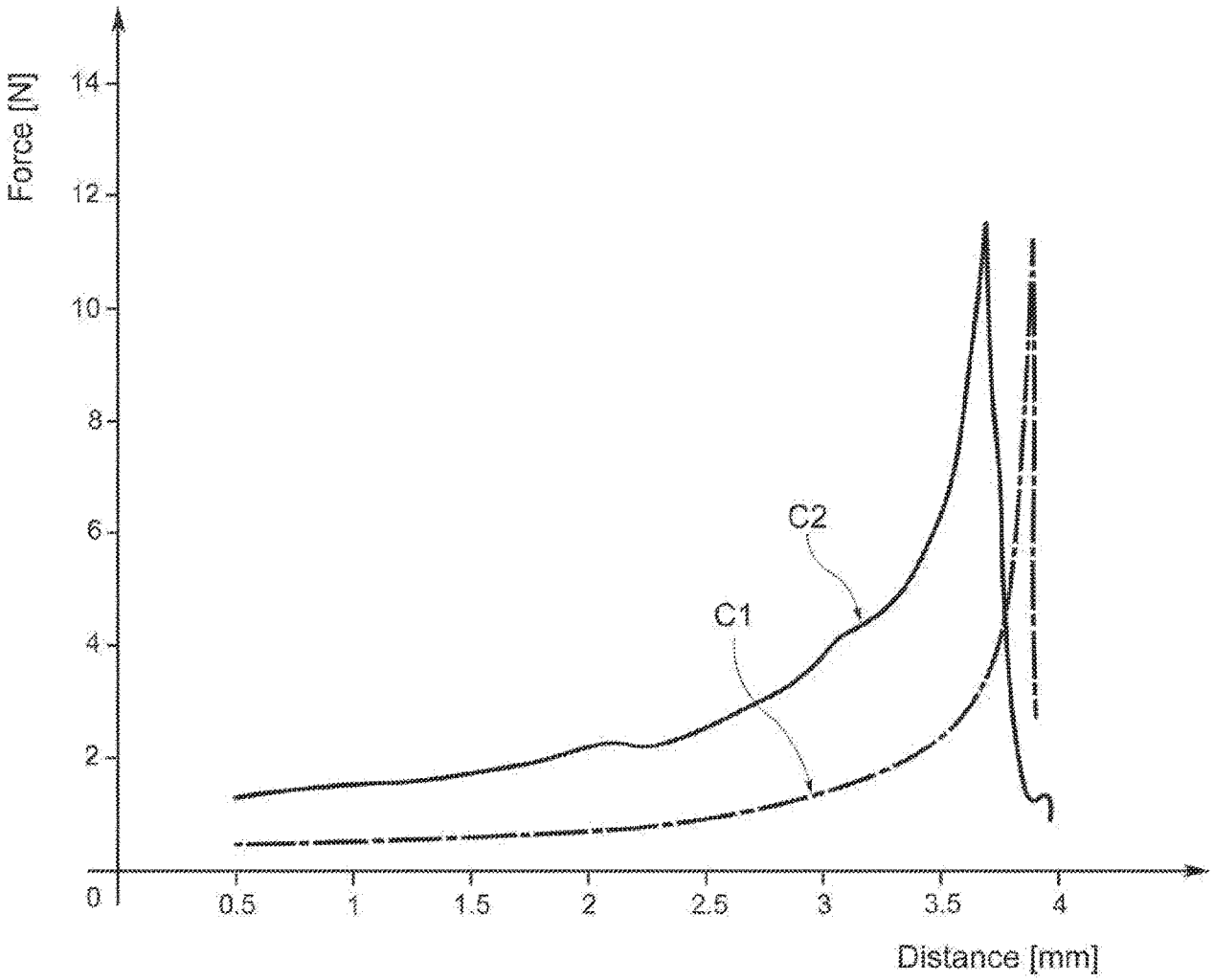
FIG. 4 is a diagram showing the operating characteristics of an actuator according to the invention and of an actuator according to the prior art.

FIG. 4 shows a diagram on which the force in newtons developed on the core of the actuator when the associated coil is energised is shown on the vertical axis, starting from the rest position towards the work position, which are shown on the horizontal axis in terms of distances travelled by the core in millimeters.

In FIG. 4, the curve shown as a chained line and indicated therein by C1 represents the variation of the force developed on the core with the variation of the distance travelled in an actuator device according to the prior art, in particular a device of the type illustrated in EP 1 722 380 A1, and the solid line indicated by C2 represents the variation of the force developed in an actuator device according to the present invention with corresponding characteristics.

As will be readily appreciated, in the actuator device according to the present invention the intensity of the force developed is, over much of the stroke or distance travelled, more than twice that developed in an actuator according to the prior art.

The actuator device according to the present invention can therefore be made in a simpler and more economical way and has improved functional characteristics.

Figure 5:
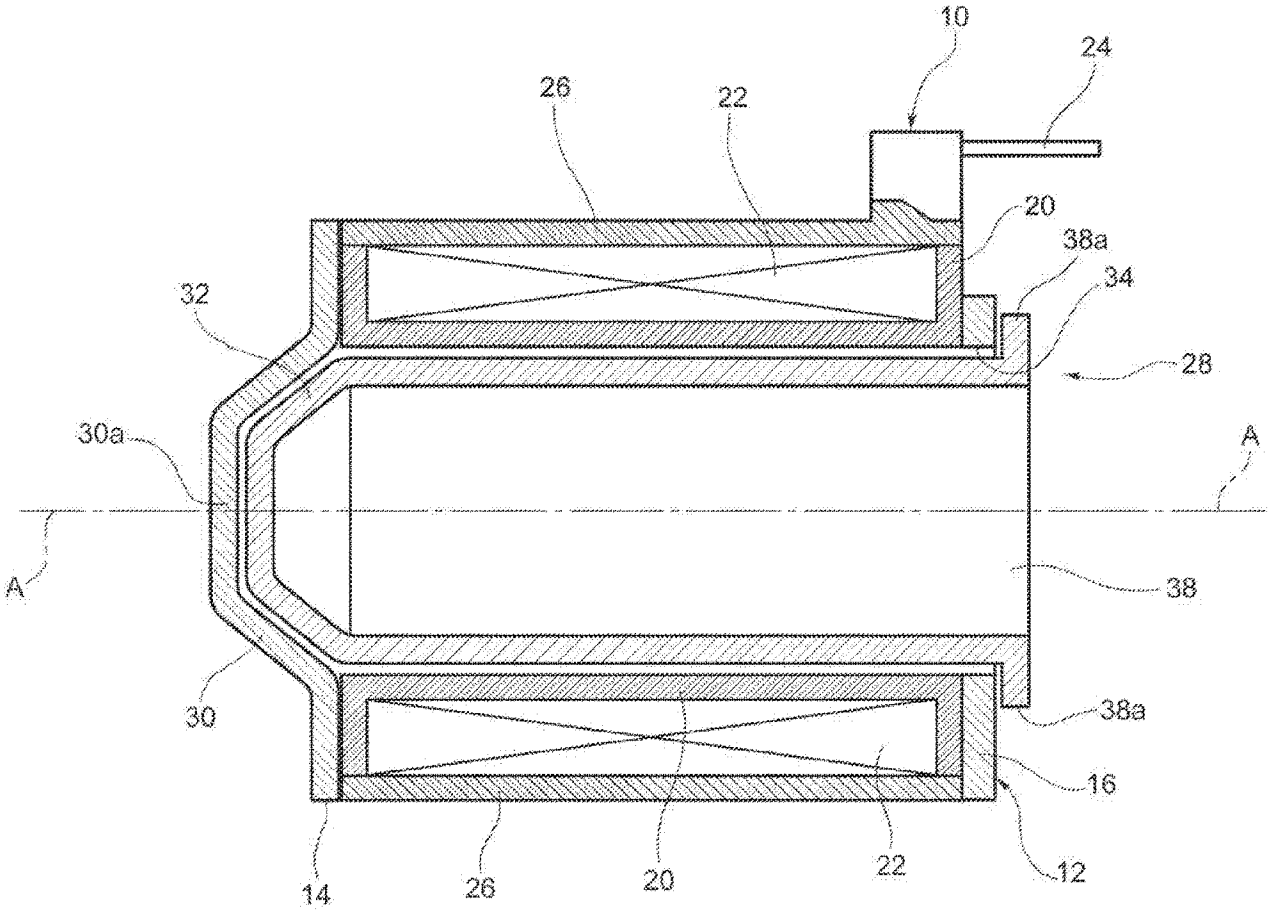
FIG. 5 is similar to FIG. 3 and shows a variant embodiment.

FIG. 5 shows a variant embodiment. In this drawing, parts and elements described previously have been given the same reference numerals as those used previously.

In this variant, the end 38 of the core 28 opposite the end 32 has a formation 38*a* protruding radially outwards, in the form of a collar, facing the lateral branch 16 of the ferromagnetic body or shell 12. This formation 38*a* can be used to increase the attractive force exerted on the core 28.

In the exemplary embodiments illustrated, the core 28 is hollow, but it could be made wholly or partially in solid form.

Naturally, the principle of the invention remaining the same, the forms of embodiment and the details of construction may be varied widely with respect to those described and illustrated, which have been given purely by way of non-limiting example, without thereby departing from the scope of the invention as defined by the attached claims.

The invention claimed is:

1. A direct current electric actuator for devices for dispensing washing agents in washing machines or, dishwashers, comprising:

a body formed by a single strip of ferromagnetic material, substantially U-shaped and including first and second lateral branches, facing each other and interconnected by an intermediate branch or portion;

an essentially frustoconical formation of ferromagnetic material converging toward a region outside said body, said frustoconical formation being blind and having a planar distal bottom wall;

a coil of insulated electrically conducting wire, fixed in said body such that an axis thereof extends in a direction substantially orthogonal to the lateral branches of said body; and a ferromagnetic core mounted so as to be movable with respect to said body in an axially translatable manner inside the coil, from a rest position to a working position, as an effect of the energising of the coil;

one end of the core, facing towards said formation of ferromagnetic material, having a frustoconical shape essentially complementary to the internal shape of said formation;

wherein said blind frustoconical formation is integrally formed with the first lateral branch of said body by stamping or drawing the single strip forming said body and extends in the region outside said body.

2. The direct current electric actuator according to claim 1, wherein the frustoconical formation of the first branch of said body defines an internal cavity having an essentially isosceles trapezium shaped profile in axial cross section, with a longer base about twice as long as the shorter base and a height or distance between said bases equal to about one third of the longer base.

3. The direct current electric actuator according to claim 1, wherein in the intermediate branch there is provided a through opening substantially equidistant from said branches, adapted to allow the engagement of a gripping device of an assembling apparatus.

4. The direct current electric actuator according to claim 1, wherein the other end of the core has an outwardly protruding formation, at least partially facing the second branch of said body.

* * * * *